US005620215A

United States Patent [19]

Janeway

[11] Patent Number: 5,620,215

[45] Date of Patent: Apr. 15, 1997

[54] SLIDING WINDOW LOCK

[76] Inventor: Kenneth Janeway, 5006 Redbud Dr., Sand Springs, Okla. 74063

[21] Appl. No.: 530,944

[22] Filed: Sep. 20, 1995

[51] Int. Cl.[6] ..... B65D 45/00

[52] U.S. Cl. ..... 292/256; 292/258; 292/288; 292/DIG. 46

[58] Field of Search ..... 292/288, 253, 292/258, 325, 256, DIG. 46; 24/302, 301, 300, 298, 615, 616

[56] References Cited

U.S. PATENT DOCUMENTS

| | | | |
|---|---|---|---|
| 765,658 | 7/1904 | Beseler | 292/258 |
| 2,998,276 | 8/1961 | Shettler | 292/288 |
| 3,059,952 | 10/1962 | Wittman et al. | 292/288 |
| 3,147,030 | 9/1964 | Berk | 292/288 |
| 3,980,202 | 9/1976 | Monyak et al. | 220/318 |
| 4,666,194 | 5/1987 | Charman | 292/288 |
| 4,694,541 | 9/1987 | Skyba | 24/301 |
| 5,144,724 | 9/1992 | Chuan | 24/68 CD |
| 5,297,828 | 3/1994 | Chung | 292/258 |
| 5,431,461 | 7/1995 | Anderson, III et al. | 292/259 |
| 5,440,790 | 8/1995 | Chou | 24/302 |
| 5,447,346 | 9/1995 | Virizi | 292/289 |
| 5,462,323 | 10/1995 | Benninger | 292/292 |

*Primary Examiner*—Steven N. Meyers
*Assistant Examiner*—Donald J. Lecher
*Attorney, Agent, or Firm*—Frank J. Catalano; Scott R. Zingerman

[57] ABSTRACT

A locking assembly secures sliding windows disposed in a common track in the closed condition. One substantially inelastic strap is permanently fixed at at one end to one sliding window and has one component of a coupling device connected at its other end. Another substantially inelastic strap is permanently fixed at one end to the other sliding window and has another component of the coupling device connected at its other end. The components of the coupling device are selectively matable and separable for respectively connecting and disconnecting the straps. The straps have a combined length such that, when the windows are in the closed condition and the coupling components are mated, the straps are tautly extended between the windows.

15 Claims, 2 Drawing Sheets

SLIDING WINDOW LOCK

BACKGROUND OF THE INVENTION

This invention relates generally to locking mechanisms for sliding windows and more particularly concerns a locking device for use with sliding windows of the type commonly found in the rear of many pick-up trucks.

Many pick-up truck rear windows include two panes which slide on a common track, the window being closed when the interior vertical edges of the panes are in abutment. It is a relatively routine procedure for thieves to gain access to the cab of the pick-up truck by slipping a knife or other similar instrument between the abutting edges of the sliding window panes and to pry the panes apart or to break or cut the latching mechanism.

It is, therefore, an object of this invention to provide a locking assembly for a common track sliding window which is more difficult to defeat than presently known devices. It is also an object of the present invention to provide a locking assembly for a common track sliding window which will discourage thieves from attempting to gain access through the window. Another object of this invention is to provide a locking assembly for a common track sliding window which is easily operable by the vehicle user to switch the window between its opened and closed conditions. A further object of this invention is to provide a locking assembly for a common track sliding window which may be readily installed by the user in an aftermarket vehicle.

SUMMARY OF THE INVENTION

In accordance with the invention, a locking assembly is provided for use with a pair of windows disposed in a common track for slidable transposition between an open condition in which the parallel inner edges of the sliding window frames are spaced apart and a closed condition in which those edges are in abutment with each other.

A rigid D-ring is connected at one end of one substantially inelastic flexible strap. A tongue extends orthogonally from a flat edge of the D-ring. Double backed adhesive tape or other adhesive means, permanently laminarly adhere a flat face of the tongue to an outside face of one of the sliding window frames with the flat edge of the D-ring abutting the outer edge of the window frame. One component of a buckle or other coupling device is connected the other end of the strap. Another rigid D-ring is connected at one end of another substantially inelastic flexible strap and its tongue also extends orthogonally from the flat edge of the D-ring. Another segment of double backed adhesive tape, or other adhesive means, permanently laminarly adheres a flat face of this tongue to an outside face of the other sliding window frame with the flat edge of this D-ring abutting the outer edge of its window frame. The other component of the buckle or coupling device is connected at the other end of this strap. The buckle components can be selectively mated or separated to respectively connect or disconnect the straps. The straps have a combined length such that, when the windows are in the closed condition with the inner edges of their frames in abutment and the buckle components are mated with the straps extending around the outer edges of the sliding window frames and along the inside faces of the sliding windows, the straps are tautly extended between the D-rings. Since the edges of the D-rings are against the outer edges of the frames, any force exerted to separate the window frames is absorbed substantially by this junction rather than by the adhesive tape which serves mainly to hold the straps in place and support the weight of the locking assembly. Furthermore, since the tongue normally extends between the frames of the sliding window and a fixed window, the tongue is prevented from rotating about its cover junction with the sliding window frame.

Alternatively, the tongue can be replaced by a U-shaped clasp contoured so as to extend along one face of the window pane or frame, around its outer edge and then along the opposite face of the window pane or frame. The clasp can be secured in place by adhesive, screws or other fastening means or combinations thereof.

The straps are preferably made of nylon of sufficient strength to resist cutting. Preferably, the length of the straps is such that the buckle is centered on the abutting edges of the window panes when the straps are taught and the buckle is made of material of sufficient strength to resist cutting, breakage or other damage.

Finally, either or both of the straps is of adjustable length so that one assembly can be used for a variety of window dimensions.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 2:
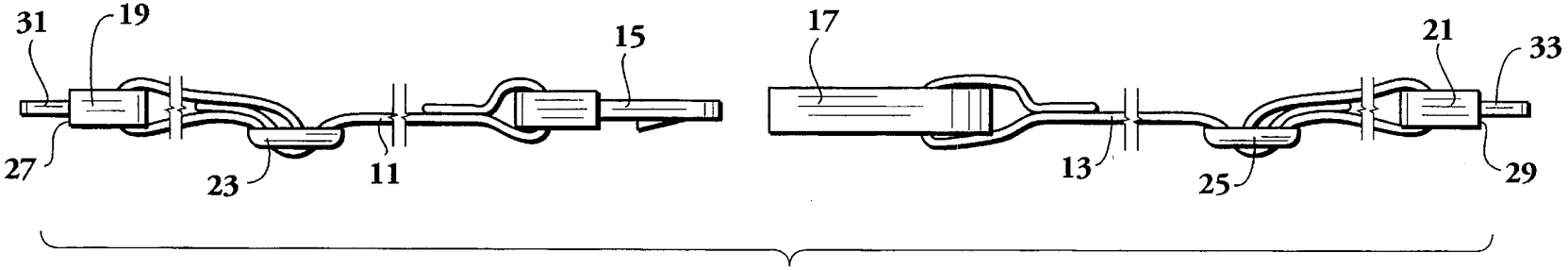
FIG. 2 is a top plan view of the sliding window lock of FIG. 1.
Figure 1:
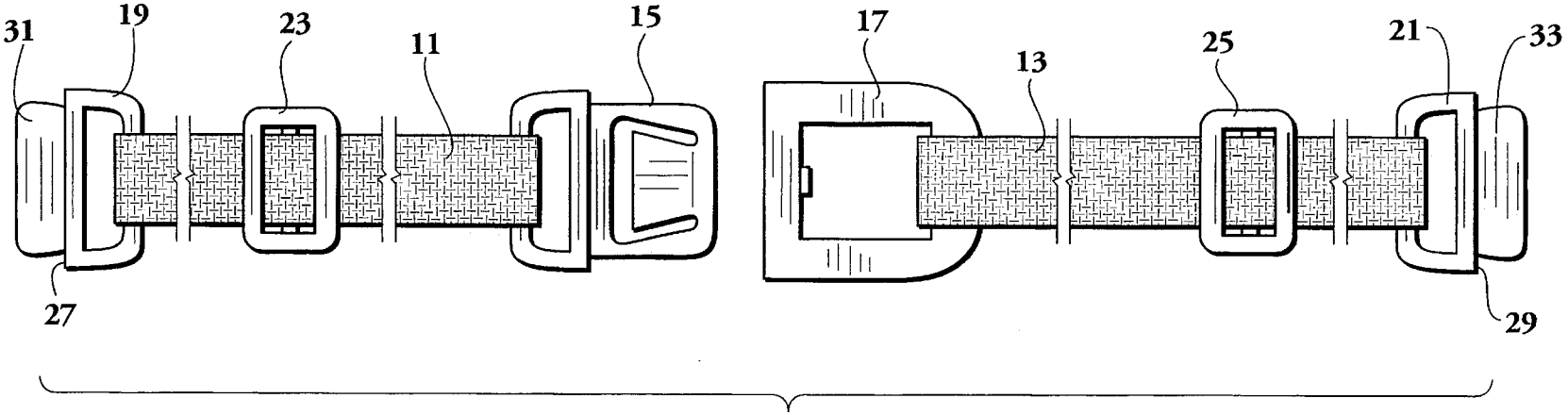
FIG. 1 is a front elevation view of a preferred embodiment of the sliding window lock.

Turning first to FIG. 1, a preferred embodiment of the common track sliding window locking assembly is illustrated which consists of a pair of substantially inelastic flexible straps 11 and 13. One end of one strap 11 is connected to one component of a coupling device such as the male portion 15 of a buckle and one end of the other strap 13 is connected to the other component of the coupling mechanism such as the female portion 17 of the buckle. The components 15 and 17 are permanently connected in place by any suitable means such as by overlapping and stitching their respective straps 11 and 13 as can best be seen in FIG. 2. Each strap 11 and 13 extends to a D-ring 19 and 21, respectively. The end of the strap 11 or 13 can be permanently secured to its respective D-ring 19 or 21 in similar fashion as the coupling components 15 and 17 were fastened. However, as shown in FIGS. 1 and 2, the preferred arrangement is to extend each of the straps 11 and 13 through their respective D-rings 19 and 21 to an adjustment ring 23 or 25, respectively, so that the length of the straps 11 and 13 can be varied. The connection of the adjustment rings 23 and 25 can be accomplished in any known manner such as by looping the end of the strap 11 or 13 around a center bar of its respective adjustment ring 23 or 25 and stitching the overlap with the portions of the straps 11 and 13 extending between the respective D-rings 19 and 21 and buckle components 15 and 17 being threaded through the adjustment rings 23 and 25. As shown, the D-rings 19 and 21 have flat edges 27 and 29 from which orthogonally extend tongues 31 and 33, respectively, such that the flat faces of the tongues 31 and 33 form corners with the flat edges 27 and 29 of the D-rings 19 and 21. Preferably, the straps 11 and 13 will be of sufficiently strong nylon or similar material so as to be flexible but also able to resist cutting. Also preferably, the components of the coupling device will be sufficiently strong to resist cutting and other damage. A polyurethane buckle capable of withstanding 1500 pounds of force would be suitable.

Figure 3:
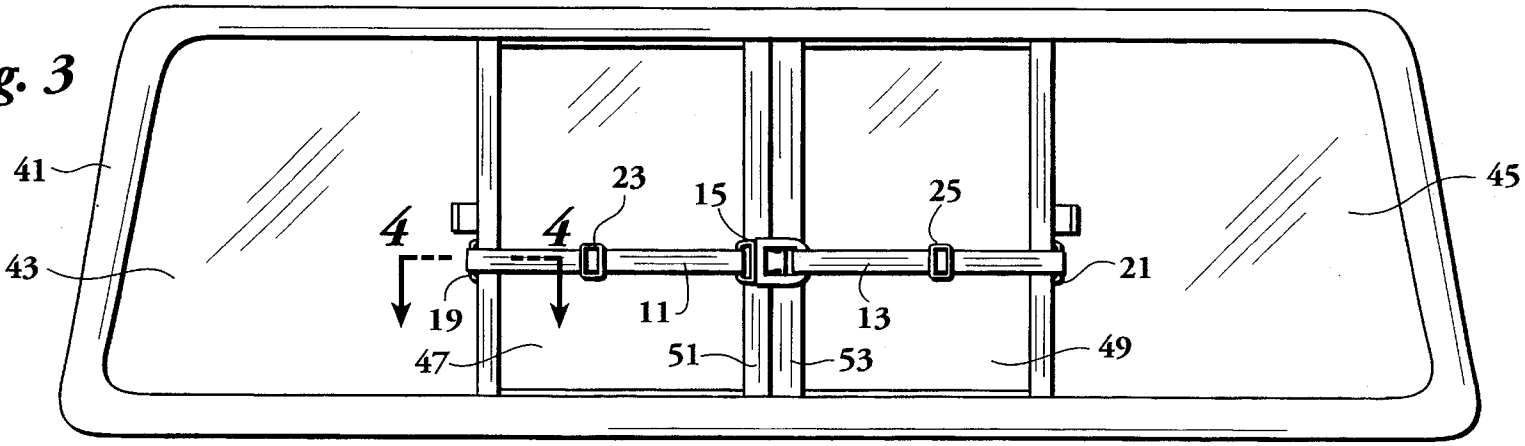
FIG. 3 is a front elevation view of the sliding window lock of FIG. 1 securing the sliding windows of a pick up truck in the closed condition.

Turning now to FIG. 3, a typical pick-up truck rear window is illustrated consisting of an outer frame 41 having fixed window panes 43 and 45 disposed at its outer ends and a pair of sliding window panes 47 and 49 mounted in frames 51 and 53, respectively, for sliding in a common track of the outer frame 41. As shown, the window is in a closed condition with the parallel inner frame portions of the frames 51 and 53 being in abutment with each other.

Figure 4:
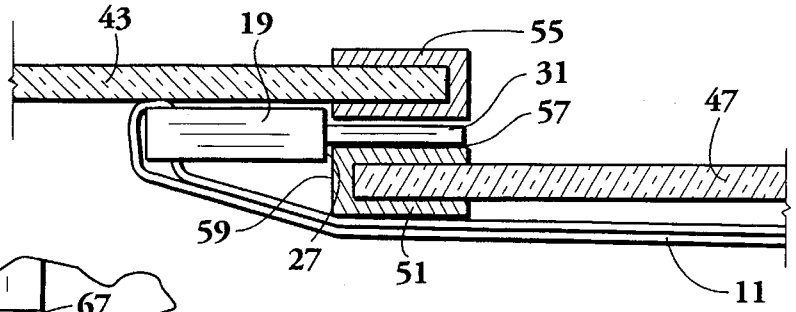
FIG. 4 is a cross-sectional view taken along the line 4—4 of FIG. 3.

Looking at FIG. 3, the sliding windows 47 and 49 are locked in the closed condition by the locking assembly shown in FIGS. 1 and 2. As is best seen in FIG. 4, the strap 11 has been connected to the pick-up truck rear window by sliding the tongue 31 of the D-ring 19 between the frame 51 of one of the sliding windows 47 and the frame 55 of the fixed window 43, or the fixed window 43 itself if no frame is used on this edge of the fixed window 43. The D-ring 19 is held in position by a section of double backed adhesive tape 57 or other suitable adhering means between the face of the tongue 31 and the face of the sliding window frame 51. As shown, the flat edge 27 of the D-ring 19 abuts the outside edge 59 of the frame 51. With the D-ring 19 thus lodged between the sliding frame and fixed frame 55, in the locked condition the strap 11 extends around the sliding frame 51 and across the inside face of the sliding window pane 47. The other D-ring 21 is secured to the other sliding window frame 53 in similar fashion. If the straps 11 and 13 are of a fixed length suited to the dimensions of the pick-up truck window, installation of the device is completed by fastening the D-rings 19 and 21 in place. However, if adjustable straps 11 and 13 are provided, the adjustment rings 23 and 25 are positioned so that when the mating components 15 and 17 of the buckle are interlocked, the straps 11 and 13 are tautly extended between the D-rings 19 and 21. Preferably, the length of the straps 11 and 13 will be selected or adjusted so that the buckle components 15 and 17 are centered on the abutment of the sliding window frames 51 and 53.

Looking again at FIG. 4, in the closed condition with the components 15 and 17 of the buckle interlocked, the longitudinal force applied to the D-ring 19 will be exerted primarily between the flat edge of the D-ring 27 and the outside face 59 of the sliding window frame 51 so that minimal force is exerted on the adhesive tape 57. Furthermore, the rotational force that would be applied to the D-ring 19 is offset by the laminar relationship of the tongue 31 of the D-ring 19 between the frames 51 and 55 of the sliding and fixed window panes 47 and 43, or between the frame 51 and the fixed pane 43 if no fixed pane frame is used. Thus, while a knife or other flat object may be inserted between the sliding frames 51 and 53, the nylon straps 11 and 13 and the polyurethane buckle components 15 and 17 are not easily cut or damaged. Furthermore, the inelastic straps 11 and 13 tautly stretched between the D-rings 19 and 21 resist the prying motion that might be exerted in an attempt to separate the closed window frames 51 and 53.

Figure 5:
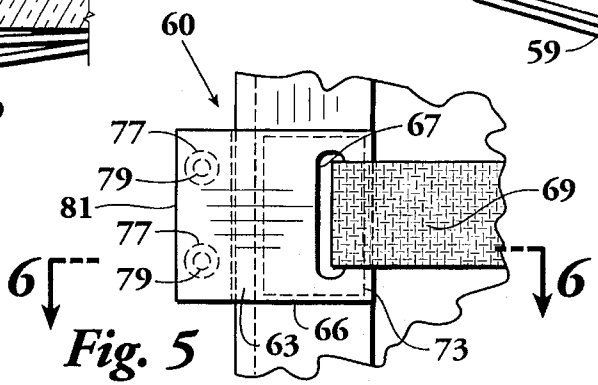
FIG. 5 is a front elevation view of an alternate connecting clasp for use with the sliding window latch.
Figure 6:
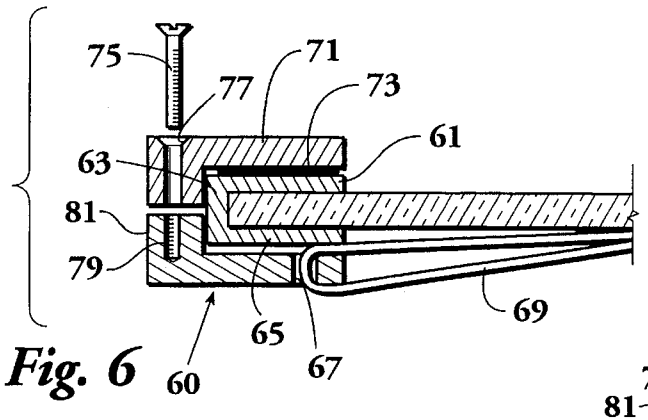
FIG. 6 is a cross-sectional view taken along the line 6—6 of FIG. 5.

Turning now to FIGS. 5 and 6, an alternate connecting device is illustrated to replace the D-rings 19 and 21 above described. A U-shaped clasp 60 extends along one face 61 of the sliding window frame, wraps around the outside edge 63 of the sliding window frame and then extends along the opposite face 65 of the sliding window frame. One leg 66 of the U-shaped clasp has a slot 67 for receiving the strap 69 and the other leg 71 of the U-shaped clasp has a segment of double backed adhesive tape 73 or other securing means for fixing the clamp 60 to the sliding window frame. Preferably, the clasp 60 will be made of two segments as shown which can be fastened together and further grip the sliding window frame therebetween by one or more screws 75. The clasps 60 are preferably made of aluminum. One leg of the clasp 60, preferably the adhesive bearing leg, may be shorter than the other or strap connecting leg. Other materials and other configurations may also be used provided they substantially apply the force exerted by the front straps of the device against the outside edges of the sliding window frames or the sliding window if no frames are used.

Thus, it is apparent that there has been provided, in accordance with the invention, a sliding window lock that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with a pair of windows disposed in a common track for slidable transposition between an open condition in which the parallel inner edges of each window frame are spaced apart and a closed condition in which the parallel inner edges of each frame are in abutment with each other, a locking assembly for securing the windows in the closed condition comprising:

a first substantially inelastic strap having a connector at one end thereof, said connector having a first tongue extending therefrom;

first means for permanently laminarly adhering said first tongue to one of the window frames and having a first portion of a coupling means connected at another end thereof;

a second substantially inelastic strap having a connector at one end thereof, said connector having a second tongue extending therefrom; and second means for permanently laminarly adhering said second tongue to the other of the window frames and having a second portion of said coupling means connected at another end thereof, said portions of said coupling means being selectively matable and separable for respectively connecting and disconnecting said first and second straps and said first and second straps having a combined length such that, when the windows are in the closed condition with the parallel inner window frame edges in abutment and said coupling means portions are mated, said straps are tautly extended between said permanently fixing means.

2. A locking assembly according to claim 1, said straps having substantially equal lengths.

3. A locking assembly according to claim 1, at least one of said straps having means connected therein for adjusting a length thereof.

4. A locking assembly according to claim 1, both of said straps having means connected therein for adjusting a length thereof.

5. A lockable sliding window assembly comprising:

a pair of windows disposed in a common track for slidable transposition between an open condition in which inner parallel edges of a frame of each said window are spaced apart and a closed condition in which said parallel inner edges are in abutment with each other;

a first substantially inelastic strap having a connector at one end thereof, said connector having a first tongue extending therefrom;

first means for permanently laminarly adhering said first tongue to one of said window frames and having a first portion of a coupling means connected at another end thereof;

a second substantially inelastic strap having a connector at one end thereof, said connector having a second tongue extending therefrom; and second means for permanently laminarly adhering said second tongue to the other of said window frames and having a second portion of said coupling means connected at another end thereof, said portions of said coupling means being selectively matable and separable for respectively connecting and disconnecting said first and second straps and said first and second straps having a combined length such that, when said windows are in the closed condition with said parallel window frame edges in abutment and said coupling means portions are mated, said straps are tautly extended between said permanently fixing means.

6. For use with a pair of windows disposed in a common track for slidable transposition between an open condition in which the parallel inner edges of each window frame are spaced apart and a closed condition in which the parallel inner edges of each frame are in abutment with each other, a locking assembly for securing the windows in the closed condition comprising:

a first substantially inelastic flexible strap;

a first rigid D-ring connected at one end of said first strap and having a tongue extending orthogonally from a flat edge thereof;

first means for permanently laminarly adhering a flat face of said first member tongue to a face of one of the window frames with said flat edge of said first D-ring abutting an outer edge of the one of the window frames;

a first portion of a coupling means connected at another end of said first strap;

a second substantially inelastic flexible strap;

a second rigid D-ring connected at one end of said second strap and having a tongue extending orthogonally from a flat edge thereof;

second means for permanently laminarly adhering a flat face of said second member tongue to a face of the other of the window frames with said flat edge of said second D-ring abutting an outer edge of the other of the window frames; and a second portion of said coupling means connected at another end of said first strap;

said portions of said coupling means being selectively matable and separable for respectively connecting and disconnecting said first and second straps and said first and second straps having a combined length such that, when the windows are in the closed condition with the parallel window frame edges in abutment and said coupling means portions are mated with said straps extending around the outer edges of said frames and along inside faces of the windows, said straps are tautly extended between said first and second D-rings.

7. A locking assembly according to claim 6, said first and second adhering means being segments of double backed adhesive tape.

8. A lockable sliding window assembly comprising:

a pair of windows disposed in a common track for slidable transposition between an open condition in which parallel inner edges of a frame of each said window are spaced apart and a closed condition in which said parallel inner edges are in abutment with each other;

a first substantially inelastic flexible strap;

a first rigid D-ring connected at one end of said first strap and having a tongue extending orthogonally from a flat edge thereof;

first means for permanently laminarly adhering a flat face of said first member tongue to a face of one of said window frames with said flat edge of said first D-ring abutting an outer edge of said one of said window frames;

a first portion of a coupling means connected at another end of said first strap;

a second substantially inelastic flexible strap;

a second rigid D-ring connected at one end of said second strap and having a tongue extending orthogonally from a flat edge thereof;

second means for permanently laminarly adhering a flat face of said second member tongue to a face of the other of said window frames with said flat edge of said second D-ring abutting an outer edge of said other of said window frames; and a second portion of said coupling means connected at another end of said first strap;

said portions of said coupling means being selectively matable and separable for respectively connecting and disconnecting said first and second straps and said first and second straps having a combined length such that, when said windows are in the closed condition with said parallel window frame edges in abutment and said coupling means portions are mated with said straps extending around outer edges of said frames and along inside faces of said windows, said straps are tautly extended between said first and second D-rings.

9. A locking assembly according to claim 8, said first and second adhering means being segments of double backed adhesive tape.

10. For use with a pair of windows disposed in a common track for slidable transposition between an open condition in which the parallel inner edges of each window frame are spaced apart and a closed condition in which the parallel inner edges of each frame are in abutment with each other, a locking assembly for securing the windows in the closed condition comprising:

a first substantially inelastic flexible strap;

a first U-shaped clasp connected at one end of said first strap, said first clasp being contoured for snugly receiving an outer edge of one of the window frames therein;

a first adhering means for securing a leg of said first clasp to the outer edge of the window frame;

a first portion of a coupling means connected at another end of said first strap;

a second substantially inelastic flexible strap;

a second U-shaped clasp connected at one end of said second strap, said second clasp being contoured for snugly receiving an outer edge of the other of the window frames therein;

a second adhering means for securing a leg of said second clasp to the outer edge of the window frame; and a second portion of said coupling means connected at another end of said first strap;

said portions of said coupling means being selectively matable and separable for respectively connecting and disconnecting said first and second straps and said first and second straps having a combined length such that, when the windows are in the closed condition with the parallel window frame edges in abutment and said coupling means portions are mated with said straps extending around the outer edges of the frames and along inside faces of the windows, said straps are tautly extended between said first and second clasps.

11. A locking assembly according to claim 10, said first and second adhering means being segments of double backed adhesive tape.

12. A lockable sliding window assembly comprising:

a pair of windows disposed in a common track for slidable transposition between an open condition in which parallel inner edges of a frame of each said window are spaced apart and a closed condition in which said parallel inner edges are in abutment with each other;

a first substantially inelastic flexible strap;

a first U-shaped clasp connected at one end of said first strap, said first clasp being contoured for snugly receiving an outer edge of one of the window frames therein;

a first adhering means for securing a leg of said first clasp to the outer edge of the window frame;

a first portion of a coupling means connected at another end of said first strap;

a second substantially inelastic flexible strap;

a second U-shaped clasp connected at one end of said second strap, said second clasp being contoured for snugly receiving an outer edge of the other of the window frames therein; and a second portion of said coupling means connected at another end of said first strap;

said portions of said coupling means being selectively matable and separable for respectively connecting and disconnecting said first and second straps and said first and second straps having a combined length such that, when the windows are in the closed condition with the parallel window frame edges in abutment and said coupling means portions are mated with said straps extending around the outer edges of said frames and along inside faces of the windows, said straps are tautly extended between said first and second clasps.

13. A locking assembly according to claim 12, said first and second adhereing means being segments of double backed adhesive tape.

14. For use with a pair of windows disposed in a common track for slidable transposition between an open condition in which the parallel inner edges of each window are spaced apart and a closed condition in which the parallel inner edges of each window are in abutment with each other, a locking assembly for securing the windows in the closed condition comprising:

a first substantially inelastic strap having a first tongue connected at one end thereof;

a first adhering means for permanently laminarly adhering said first tongue to one of the windows and having a first portion of a coupling means connected at another end thereof;

a second substantially inelastic strap having a second tongue connected at one end thereof; and a second adhering means for permanently laminarly adhering said second tongue to the other of the windows and having a second portion of said coupling means connected at another end thereof, said portions of said coupling means being selectively matable and separable for respectively connecting and disconnecting said first and second straps and said first and second straps having a combined length such that, when the windows are in the closed condition with the parallel inner window edges in abutment and said coupling means portions are mated, said straps are tautly extended between said permanently fixing means.

15. A lockable sliding window assembly comprising:

a pair of windows disposed in a common track for slidable transposition between an open condition in which inner parallel edges of each said window are spaced apart and a closed condition in which said parallel inner edges are in abutment with each other;

a first substantially inelastic strap having a first tongue connected at one end thereof;

a first adhering means for permanently laminarly adhering said first tongue to one of said windows and having a first portion of a coupling means connected at another end thereof;

a second substantially inelastic strap having a second tongue connected at one end thereof; and a second adhering means for permanently laminarly adhering said second tongue to the other of said windows and having a second portion of said coupling means connected at another end thereof, said portions of said coupling means being selectively matable and separable for respectively connecting and disconnecting said first and second straps and said first and second straps having a combined length such that, when said windows are in the closed condition with said parallel window edges in abutment and said coupling means portions are mated, said straps are tautly extended between said permanently fixing means.

* * * * *